US006554700B2

(12) United States Patent
Dixon

(10) Patent No.: US 6,554,700 B2
(45) Date of Patent: Apr. 29, 2003

(54) RIDGE VENT FOR TILE ROOFS

(76) Inventor: David J. Dixon, 5080 Glenway, Brighton, MI (US) 48116

( * ) Notice: Subject to any disclaimer, the term of this patent is extended or adjusted under 35 U.S.C. 154(b) by 0 days.

(21) Appl. No.: 10/055,099

(22) Filed: Jan. 22, 2002

(65) Prior Publication Data

US 2002/0068522 A1 Jun. 6, 2002

Related U.S. Application Data

(63) Continuation-in-part of application No. 09/695,523, filed on Oct. 24, 2000, now abandoned.
(60) Provisional application No. 60/161,503, filed on Oct. 26, 1999.

(51) Int. Cl.[7] ..... F24F 7/02
(52) U.S. Cl. ..... 454/365; 52/199
(58) Field of Search ..... 454/364, 365; 52/199

(56) References Cited

U.S. PATENT DOCUMENTS

| | | | | |
|---|---|---|---|---|
| 183,532 A | * | 10/1876 | Brock | 454/365 |
| 835,966 A | | 11/1906 | Lyster | |
| 1,307,228 A | | 6/1919 | Wickstrom | |
| 3,185,070 A | | 5/1965 | Smith | |
| 4,643,080 A | | 2/1987 | Trostle et al. | |
| 4,709,723 A | * | 12/1987 | Sidaway et al. | 137/584 |
| 5,050,489 A | | 9/1991 | Mankowski | |
| 5,222,334 A | * | 6/1993 | Hasty | 52/100 |
| 5,890,960 A | * | 4/1999 | Cronan et al. | 454/365 |
| 6,128,870 A | | 10/2000 | Kohler | 454/365 X |

FOREIGN PATENT DOCUMENTS

| | | | |
|---|---|---|---|
| GB | 2211287 | 6/1989 | 454/365 |

OTHER PUBLICATIONS

Air Vent, Inc., Dallas, Texas, "Ridge Ventilation Systems" AVIO23–8/99.

* cited by examiner

*Primary Examiner*—Harold Joyce
(74) *Attorney, Agent, or Firm*—Harness Dickey & Pierce P.L.C.

(57) ABSTRACT

A ridge vent adapted specifically for use with tile roofs, and which does not require a nailer board to be installed on a roof prior to installing the ridge vent. The ridge vent includes a main body portion, a neck portion extending from the main body portion and a pair of flanges depending from the neck portion and extending away from one another. The flanges are adapted to be secured directly to a roof after the ridge vent is placed over an opening at the ridge of the roof. The neck portion includes a pair of accordion-like panels which permit the length of the neck portion to be increased or shortened to vary the spacing between the main body portion and the flanges. This enables the ridge vent to accommodate roof tiles having varying radaii of curvature. A plurality of living hinge portions permit the ridge vent to be unfolded into a relatively flat orientation to make same easier to package and ship.

19 Claims, 4 Drawing Sheets

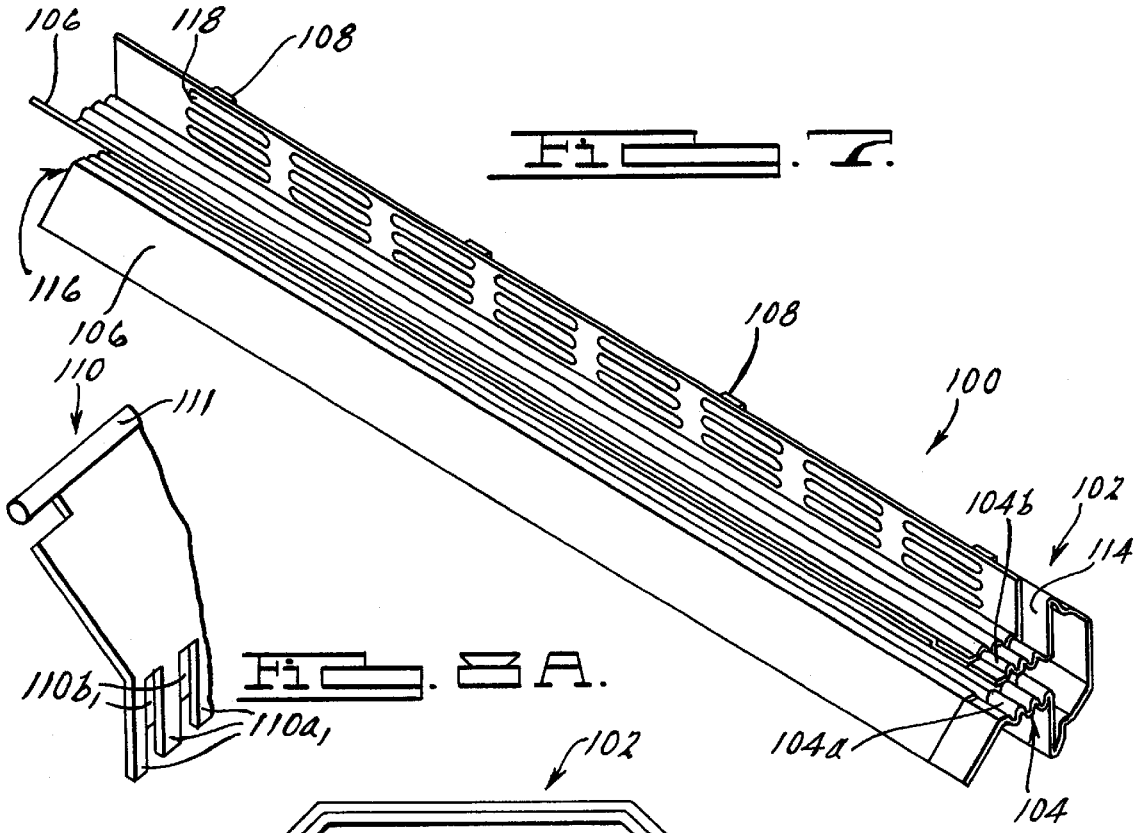
FIG. 7.
FIG. 8A.
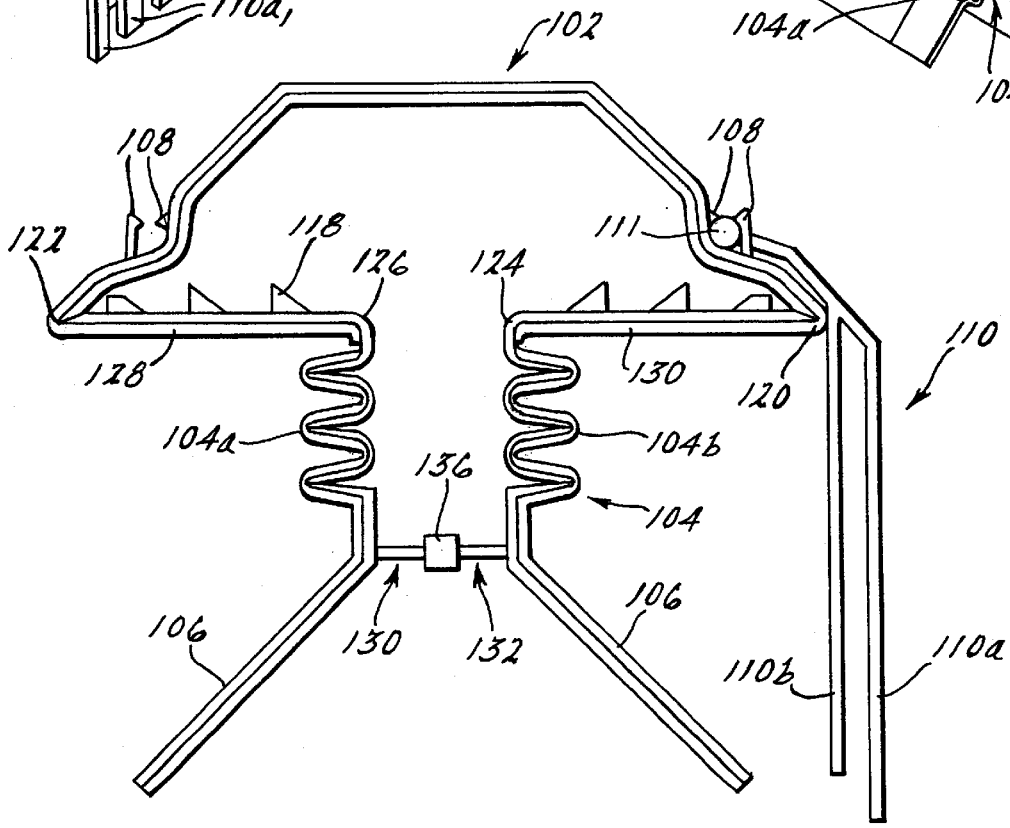
FIG. 8.

RIDGE VENT FOR TILE ROOFS

CROSS REFERENCE TO RELATED APPLICATIONS

This application is a continuation-in-part of United States patent application Ser. No. 09/695,523 filed on Oct. 24, 2000, abandoned.

This application claims the benefit of U.S. Provisional Application Ser. No. 60/161,503, filed Oct. 26, 1999.

FIELD OF THE INVENTION

This invention relates to roof vents for residential or commercial dwellings, and more particularly to a roof vent specifically adapted for use with tile covered roofs.

BACKGROUND OF THE INVENTION

Tile roof ridge vents are typically used to vent an attic area of a residential or commercial dwelling, which area can become extremely hot during summer months. Typically, existing tile roof ridge vents require a nailer board, which is usually a 2×4 or 2×6 stud, to be secured to the trusses along the ridge such that the stud stands up and forms a surface to which the ridge vent can be secured. The ridge vents are usually two or three piece components which have a pair of flanges flaring outwardly away from each other. The flanges are adapted to be nailed to the roof. A cap portion of the ridge vent is then nailed to an upper edge surface of the 2×4 or 2×6. Tiles are then placed over the flanges.

The requirement for a nailer board (i.e., either a 2×4 or 2×6) thus represents a significant additional assembly step, as well as a significant additional cost, when installing tile ridge vents. Installing the nailer board alone often requires that the upper edges (i.e., apexes) of the trusses be cut to form a flat surface to which the nailer board can be secured. This significantly increases the time, cost and effort associated with installing ridge vents for tile roofs.

It would therefore be highly desirable to provide a ridge vent adapted specifically for use with tile roofs which does not require a nailer board to be installed before the ridge vent can be secured to the roof.

It would also be highly desirable to provide a ridge vent which comprises a single piece component which can be quickly and easily secured to the ridge of a roof over an opening in the roof, and which does not require the installation of a nailer board before installing the ridge vent.

It would further be desirable to provide a ridge vent having an expandable neck portion to accommodate roof tiles of different sizes.

It would also be highly desirable to provide a ridge vent which is relatively inexpensive to produce, lightweight, and which completely eliminates the use of a nailer board as a prerequisite to installing the ridge vent.

SUMMARY OF THE INVENTION

The above and other objects are provided by a ridge vent in accordance with a preferred embodiment of the present invention. The ridge vent of the present invention generally comprises a main body portion having a pair of oppositely extending eaves, a neck portion and a pair of oppositely extending flanges. The eaves each have a plurality of slots formed therein for allowing air to enter and exit the ridge vent once it is installed on a roof. The ridge vent forms a one-piece component which is extremely lightweight, relatively inexpensive to produce and, most importantly, completely eliminates the need for installing a nailer board on at the ridge of the roof before installing the ridge vent.

The ridge vent of the present invention is installed by positioning it over an opening formed at the ridge of a roof. The flanges are then secured by threaded screws or nails to the roof. The neck portion spaces the main body portion a short distance above the roof while the slots in the eaves allow air to circulate into and out from the ridge vent. Since no nailer board is required to support any portion of the ridge vent, installation time is significantly reduced. A tile cap may then be secured over the main body portion such as by threaded screws.

In an alternative preferred embodiment, the ridge vent includes an accordion-like neck portion which allows the main body to be adjustably spaced closer to or farther away from the flanges. The main body further includes a plurality of integrally formed clips for holding an independent cover member which may be supported from the main body portion via the clips. This embodiment is further completely formed by a suitably high strength plastic as a single piece unit. In one preferred form, certain corner portions of the main body comprise living hinges which allow the vent portion and the main body portion to be laid out substantially flat. This enables the ridge vent to be packaged and shipped in a much more compact container, thus reducing shipping and packaging costs.

BRIEF DESCRIPTION OF THE DRAWINGS

The various advantages of the present invention will become apparent to one skilled in the art by reading the following specification and subjoined claims and by referencing the following drawings in which:

FIG. 7 is a perspective view of a ridge vent in accordance with an alternative preferred embodiment of the present invention;

FIG. 8 is a cross sectional view taken in accordance with section line 8—8 in FIG. 7;

FIG. 9 is a top view of the ridge vent of FIG. 7 showing the male end thereof in greater detail;

DETAILED DESCRIPTION OF THE PREFERRED EMBODIMENTS

Figure 1:
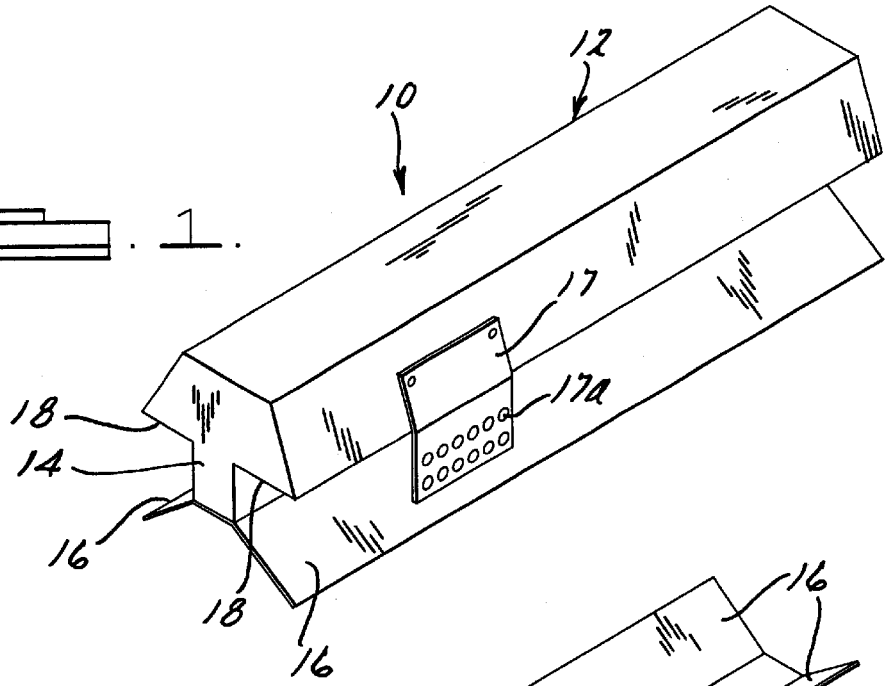
FIG. 1 is a perspective view of a tile ridge vent in accordance with a preferred embodiment of the present invention.

Referring to FIG. 1, there is shown a ridge vent 10 specifically adapted for use with tile roofs. The ridge vent 10 may be made from metal, plastic, aluminum or any other suitable, lightweight material or sheet metal. The ridge vent 10 generally comprises a main body portion 12 forming a hollow area therewithin, a hollow neck portion 14 and a pair of flanges 16 which depend from the neck portion 12 and which flare outwardly away from each other.

Figure 2:
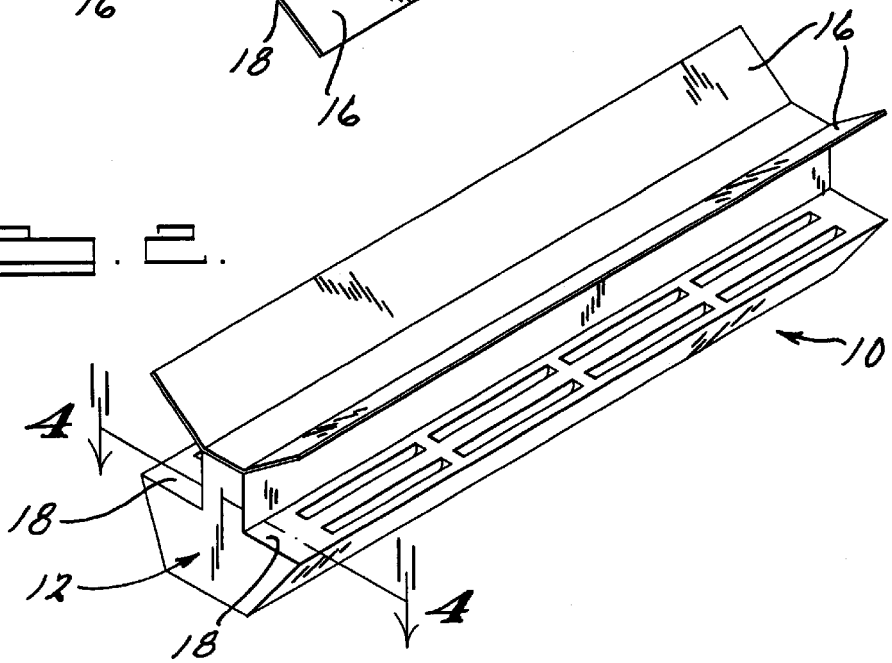
FIG. 2 is a perspective view of the undersurface of the ridge vent of FIG. 1.
Figure 3:
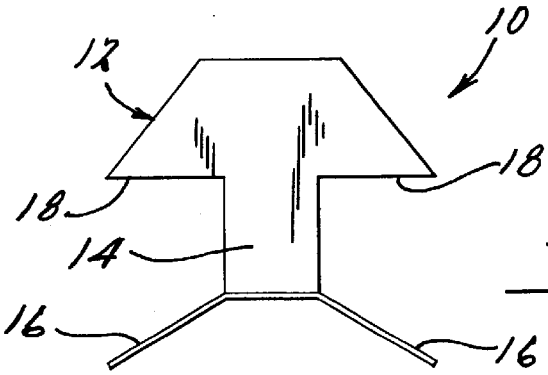
FIG. 3 is an end view of the ridge vent of FIG. 1.

Referring to FIGS. 2 and 3, the main body portion 12 includes a pair of eaves 18 each having a plurality of slots 20 formed therein. While eight slots 20 are shown formed in each eave 18, it will be appreciated that the number of slots could vary significantly depending upon the overall dimensions of the ridge vent 10 or the desired degree of airflow therethrough. Optionally, as shown in FIG. 1, a cover 17 having a plurality of openings 17*a* could be secured to the main body portion 17 to ensure that the slots 20 are blocked from view. If incorporated, the cover 17 would preferably extend along the entire length of the ridge vent 10. The cover 17 could comprise a piece of sheet metal or aluminum which is painted to match the color of the roof tiles to be used on the building on which the ridge vent 10 is secured. The cover could be attached by threaded screws, rivets or any suitable means for securing it to the main body portion 12. Preferably, two covers 17 will be used, one on each side of the main body portion 12.

Figure 4:
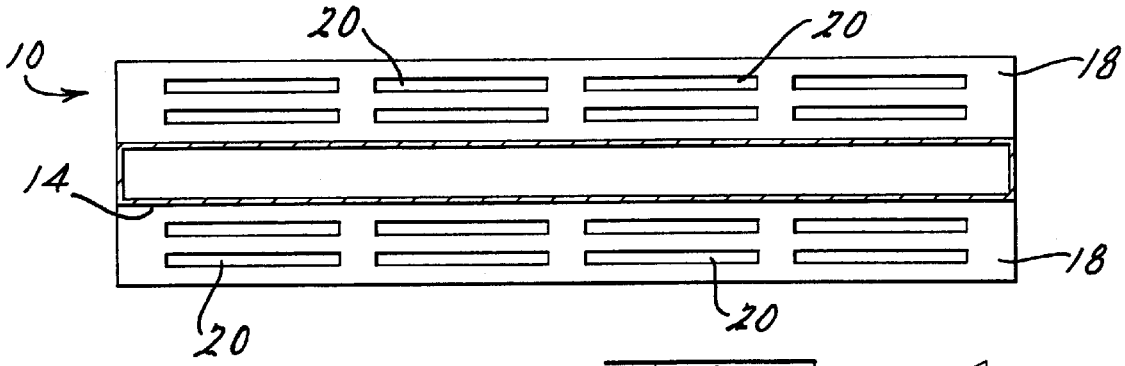
FIG. 4 is a cross sectional plan view of the ridge vent of FIG. 2 taken in accordance with section line 4—4 in FIG. 2.

Referring now to FIG. 4, it can be seen that the flanges 16 are formed so as to extend at a slight angle relative to the horizontal to aid in fastening to a roof. This angle can also vary considerably, depending upon the pitch of the roof, but is preferably with a range of about 30–80 degrees. The neck portion 14 can also be seen to space the main body portion 12 away from the flanges 16, and thus away from the roof, to allow air to easily circulate into and out from the ridge vent 10.

Figure 5:
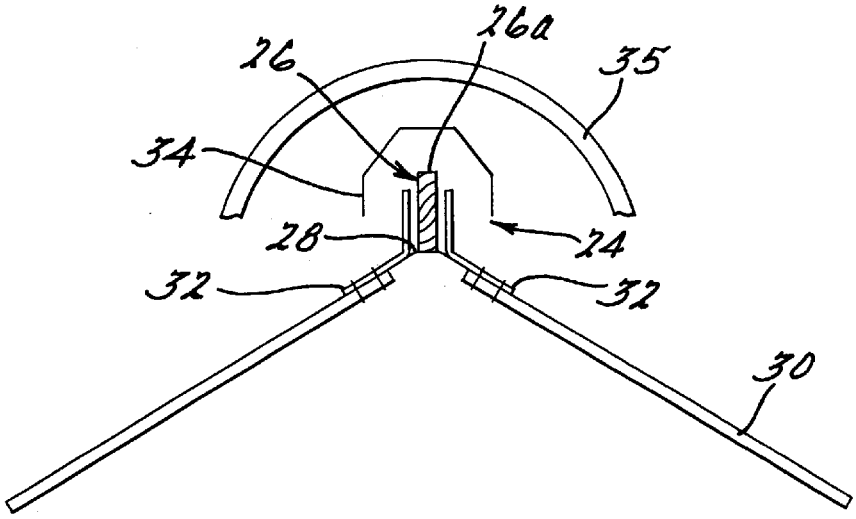
FIG. 5 is a simplified schematic representation of the installation of a prior art tile ridge vent showing the use of a nailer board to which the components of the ridge vent are attached.

With reference now to FIG. 5, a prior art ridge vent installation is shown. The prior art ridge vent 24 requires a nailer board 26 to be attached to the trusses 28 of the roof 30. The nailer board 26 is typically a 2×4 or 2×6 stud. Usually the upper edges of the trusses 28 need to be cut to form a flat surface to which the nailer board 26 can be secured to. The prior art ridge vent includes flanges 32 which are secured to the roof 30 on opposite sides of the nailer board 26. An upper vent component 34 is then secured to an upper edge 26*a* of the nailer board 26 by nails or screws. A decorative cap 35 may then be secured over the upper vent component 34 and to the nailer board 26. Thus, the prior art ridge vent 24 forms a multipiece component that cannot be secured to a roof without the nailer board 26.

Figure 6:
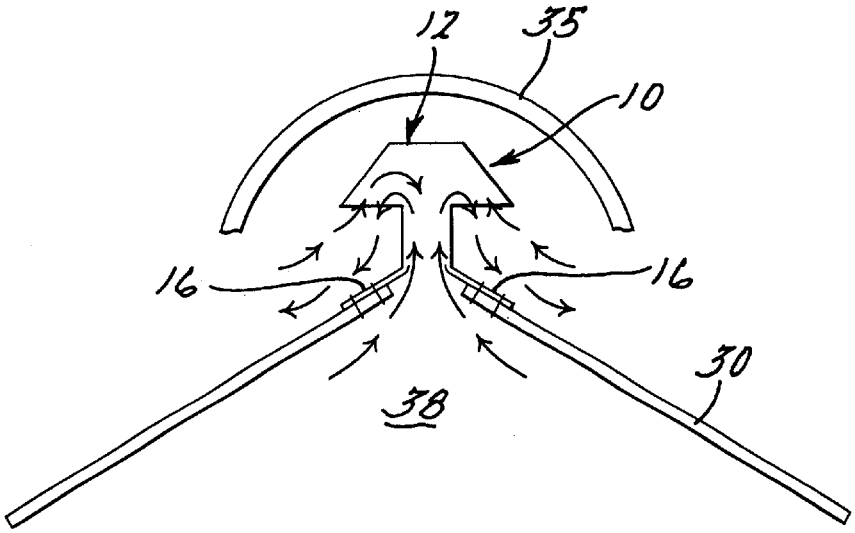
FIG. 6 is a simplified schematic representation of the installation of the ridge vent of the present invention secured to a roof.

Referring now to FIG. 6, the ridge vent 10 of the present invention is shown secured to the roof 30. It will be appreciated immediately that the nailer board 26 shown in FIG. 5 is not needed for installation of the ridge vent 10. The flanges 16 are secured to the roof 30 by nails or threaded screws after the ridge vent 10 is positioned over the opening at the ridge of the roof 30. Decorative cap component 35 may then be secured with additional nails or threaded screws to the main body portion 12 of the ridge vent 10. A screen (not shown) may also optionally be installed over the opening prior to installing the ridge vent 10 to further ensure against the entry of small animals through the opening. The slots 20 (not visible in FIG. 6) enable air, represented by arrows 36, to circulate freely into and out from the ridge vent 10, and thus the attic area 38 beneath the roof 30. Advantageously, the slots 20 open downwardly, which significantly reduces or eliminates the risk of wind driven rain, snow or other elements entering therethrough. This is in contrast with other tile roof vents, which have vent openings along a vertically disposed portion which can allow the entry of wind driven rain or snow.

From the above it will be appreciated that the ability to install the ridge vent 10 without having to previously install a nailer board represents a significant time, effort and cost savings. This can significantly expedite the installation of the ridge vents 10 while reducing the overall cost associated with the installation process. The ridge vents 10 are further formed in one piece to further enhance the convenience of handling and installing same. Furthermore, the ridge vents 10 can be provided in a variety of profiles, materials and colors to suit the needs of a specific application. The degree of ventilation provided by the ridge vent 10 is also superior to the ventilation capable of being provided by off ridge vents.

Referring to FIG. 7, there is shown a ridge vent 100 in accordance with an alternative preferred embodiment of the present invention. The ridge vent 100 is similar to the ridge vent 10 with the exception that the ridge vent 100 is made entirely from a suitably high strength plastic, such as, for example, polypropylene. The ridge vent 100 includes a head portion 102, a neck portion 104 and a pair of flanges 106. The neck portion 104 is formed with accordion-like panels 104*a* and 104*b* which allow the head portion 102 to be positioned closer to or farther away from the flanges 106. This allows the ridge vent 100 to easily accommodate arcuate roof tiles having varying radaii of curvature. The accordion-like panels 104*a* and 104*b* forming the neck portion 104 thus allow a single ridge vent 100 to be used with roof tiles of varying radaii. This eliminates the need to manufacture and stock ridge vents having neck portions of different lengths to accommodate different styles and sizes of roof tiles.

Referring to FIG. 8, the main body 102 of the ridge vent 100 further includes a pair of integrally formed, opposing catch members 108 which are used to support an independent cover member 110. The catch members 108 capture a bead 111 of the cover member 110 when the bead 111 is snapped into the catch members 108. The cover member 110 can then be slid longitudinally along the main body portion 102 a small degree, if needed.

With reference to FIGS. 8 and 8*a*, the cover member 110 includes a first layer of fins or fingers 110*a* spaced apart from a second layer of fins or fingers 110*b*. The first layer of fins 110*a* comprises a plurality of individual fins 110*a*, which are staggered, laterally, from a plurality of fins $\mathbf{110}b_1$. When layed on an arcuate roof tile, the two layers 110*a* and 110*b* conform to the contour of roof tile and the gaps between the fins $\mathbf{110}a_1$ and $\mathbf{110}b_1$ permit air to circulate out through the ridge vent 100.

It is anticipated that in some applications the cover member 110 may alternatively include scalloped cutouts at its lower end portion for resting over semicircular roof tiles which are abutted up underneath the main body portion 102 of the ridge vent 100. Such scalloped portions will allow the cover member 110 to match the contour of the roof tiles.

Since the catch members 108 allow the cover member 110 to be slid longitudinally along the main body 102 by at least a small degree, the cover member 110 can be precisely aligned over the roof tiles. It will also be appreciated that the cover member 110, in this alternative embodiment, would include a plurality of openings 112 formed therein for allowing air to circulate out through the ridge vent 100.

Referring to FIG. 9, a portion of the ridge vent 100 can be seen in greater detail. The ridge vent 100 includes a male end 114 which is designed to be inserted into a female end 116 (FIG. 7) of another section of the ridge vent 100. In this manner a plurality of ridge vents 100 can be used to form a single, elongated ridge vent assembly. It will be appreciated that adhesives or even a suitable fastening clip could be employed to hold the male end 114 of one ridge vent 100 within the female end 116 of an adjacent ridge vent 100.

FIGS. 7 and 8 also illustrate more clearly a plurality of louvers 118 formed in an undersurface of the main body 102 adjacent each of the accordion-like panels 104*a* and 104*b*. The louvers 118 allow easy egress of air through the main body 102 to allow ventilation of the structure to which the ridge vent 100 is attached.

Figure 10:
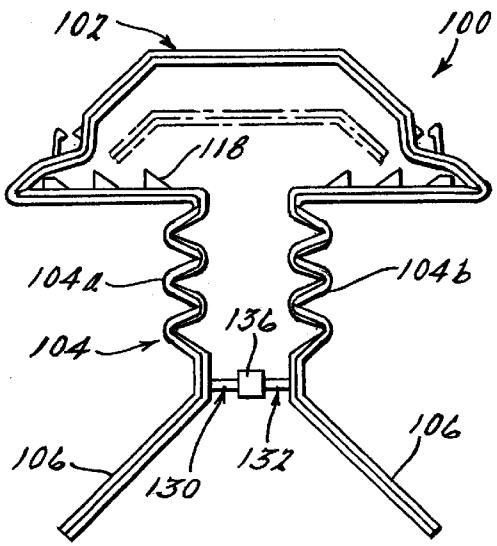
FIG. 10 is an end view of the ridge vent showing the neck portion thereof extended.

Referring now to FIG. 10, the ridge vent 100 can be seen with its neck portion 104 in an extended orientation, as compared with the drawing of FIG. 8. The additional room provided by the accordion-like panels 104*a* and 104*b* allows arcuate roof tiles having different radaii of curvature to be easily inserted underneath the main body 102.

Figure 11:
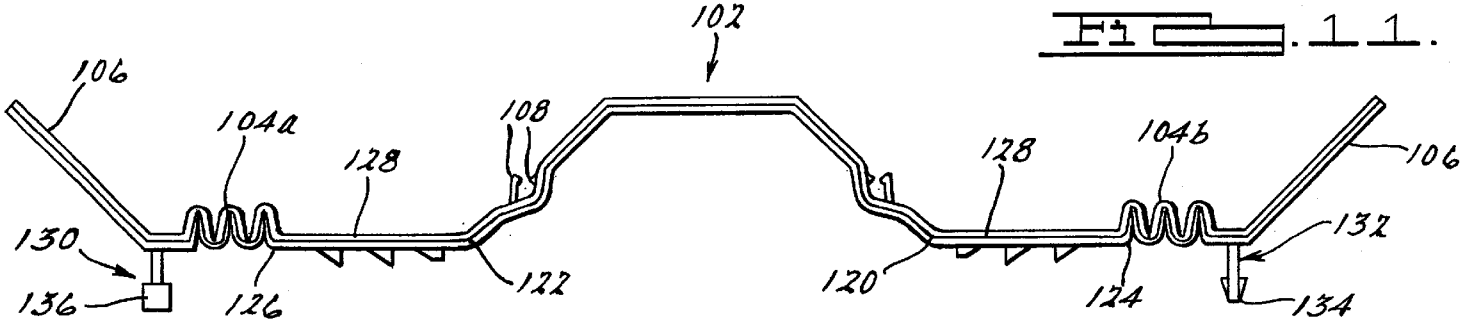
FIG. 11 is an end view of the ridge vent showing the ridge vent flattened into the position it assumes when being packaged for shipping.
Figure 5:
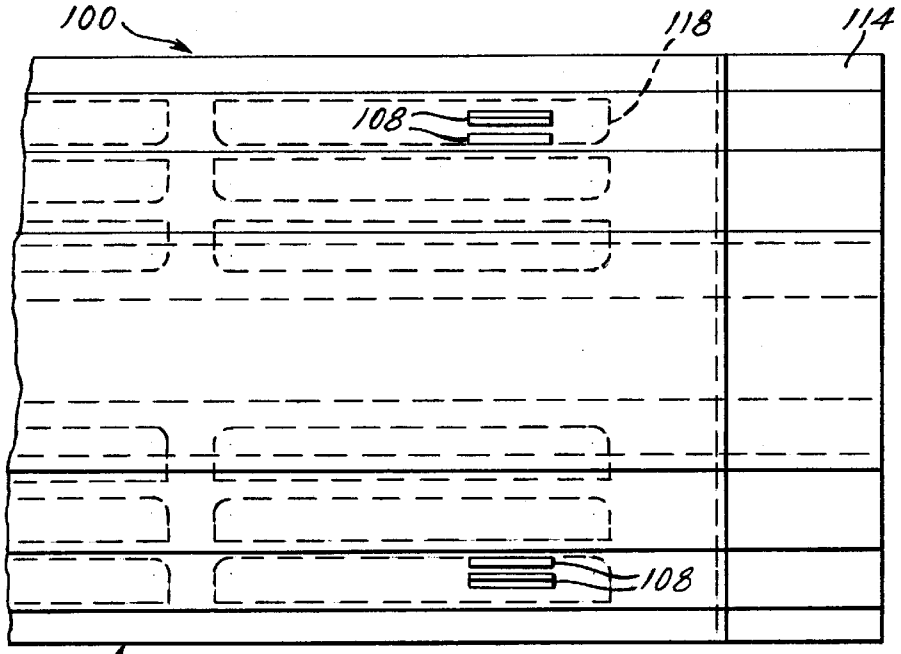

Referring now to FIGS. 8 and 11, the ridge vent 100 also includes corners 120, 122, 124 and 126, which are each formed as a living hinge. This allows panel portions 128 and 130, within which the louvers 118 are formed, as well as the accordion-like panels 104*a* and 104*b*, to be folded out into a relatively flat orientation, as shown in FIG. 11. Placing the ridge vent 100 in the orientation of FIG. 11 provides a component which can be stacked and shipped in a much more compact shipping container, thus reducing shipping costs.

With further reference to FIGS. 8, 10 and 11, a first (i.e., female) locking element 130 is formed to project from neck panel 104*a*, and a second (i.e., male) locking element 132 is formed to project from neck portion 104*b*. Second locking element 132 includes a barbed end 134 and first locking element 130 includes a head portion 136 for capturing the barbed end 134 therein. When the ridge vent 100 is to be assembled for use, the ridge vent is folded from the orientation shown in FIG. 11 to that shown in FIG. 10, and the barbed end 134 is inserted into the head portion 136 and is lockingly retained therein. This serves to hold the ridge vent in the orientation shown in FIGS. 8 and 10.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A ridge vent for a roof of a dwelling, comprising:

a main body portion having at least one eave portion and a pair of flanges extending in diverging relationship to one another;

said flanges being securable to portions of said roof on opposite sides of a ridge of said roof to thereby mount said ridge vent on said dwelling without the use of a nailer board positioned along said ridge;

wherein said eave portion includes a plurality of openings to permit airflow to circulate into and out from an interior area of said dwelling; and wherein said main body portion includes an extendable neck portion for allowing said main body portion to be adjustably spaced from said flanges.

2. The ridge vent of claim 1, wherein said extendable neck portion comprises at least one accordion-like panel.

3. The ridge vent of claim 1, wherein said extendable neck portion comprises a pair of accordion-like panels disposed in facing relationship to one another.

4. The ridge vent of claim 1, wherein said main body portion includes a pair of eave portions each having a plurality of openings formed therein.

5. The ridge vent of claim 4, wherein each said eave portion includes a plurality of openings formed therein.

6. The ridge vent of claim 1, wherein said ridge vent is comprised of aluminum/galvanized metal, copper.

7. The ridge vent of claim 1, wherein said ridge vent is comprised of plastic.

8. The ridge vent of claim 1, wherein said extendable neck portion forms a hollow area in airflow communication with an interior area of said dwelling and includes a pair of accordion-like panels.

9. The ridge vent of claim 1, wherein said flanges each extend at an angle of about 30°–80° from a horizontal plane extending through said flanges.

10. The ridge vent of claim 1, wherein said ridge vent comprises a plurality of living hinge portions for enabling said ridge vent to be extended into a substantially flat orientation.

11. The ridge vent of claim 1, wherein said ridge vent comprises a male end and a female end, said male end being adapted to engage with said female end of an adjacently positioned ridge vent.

12. A ridge vent for ventilating an attic of a dwelling, said ridge vent comprising:

a pair of flanges secureable directly to a roof of said dwelling;

an accordion-like neck portion forming a hollow interior area and extending away from said flanges, a main body portion extending from said neck portion;

a pair of eave portions each having a plurality of openings for circulating air into and out of said attic, said eave portions extending outwardly from said neck portion; and wherein said accordion-like neck portion can be extended and retracted to adjust a spacing between flanges and said main body portion.

13. The ridge vent of claim 12, wherein said flanges extend at an angle of between about 30°–80° from a horizontal plane extending through said flanges.

14. The ridge vent of claim 12, wherein said openings in said eave portions are comprised of louvers.

15. The ridge vent of claim 12, wherein said ridge vent is comprised of plastic.

16. A ridge vent for ventilating an attic of a dwelling, said ridge vent comprising:

a main body portion having a pair of eave portions, a pair of flanges extending in diverging relation to one another, and a neck portion for spacing said eave portions apart from said flanges;

each of said eave portions including a plurality of openings for allowing air to circulate into and out from an interior area of said ridge vent;

wherein said flanges extend at an angle of between about 30°–80° from a horizontal plane extending through said flanges, and wherein said flanges are adapted to be secured directly to an outer surface of said roof over a ridge of said roof to thereby support said ridge vent on said roof without the use of a railer board; and wherein said neck portion includes at least one accordion-like panel which allows said neck portion to be lengthened and shortened to adjust a spacing between said main body portion and said flanges.

17. The ridge vent of claim 16, wherein said ridge vent is comprised of plastic.

18. The ridge vent of claim 16, wherein said neck portion comprises a pair of accordion-like neck panels.

19. The ridge vent of claim 16, wherein said ridge vent includes a plurality of living hinge portions for enabling said ridge vent to be unfolded into a substantially flat orientation.

* * * * *